United States Patent [19]

Huth

[11] Patent Number: 4,838,498

[45] Date of Patent: Jun. 13, 1989

[54] WEB TENSIONING SYSTEM

[75] Inventor: Michael Huth, LaGrange Park, Ill.

[73] Assignee: Rockwell International Corporation, Pittsburgh, Pa.

[21] Appl. No.: 159,309

[22] Filed: Feb. 22, 1988

[51] Int. Cl.[4] ..... B65H 59/38

[52] U.S. Cl. ..... 242/75.51; 242/75.53

[58] Field of Search ..... 242/75.51, 75.53, 75.43, 242/75.44, 75.5, 45

[56] References Cited

U.S. PATENT DOCUMENTS

| | | | |
|---|---|---|---|
| 2,997,248 | 8/1961 | Chase et al. | 242/75.42 |
| 3,061,227 | 10/1962 | Peterson | 242/75.42 |
| 3,083,602 | 4/1963 | Obenshain | 242/75.53 |
| 3,416,051 | 12/1968 | Pinto et al. | 242/75.51 |
| 3,822,838 | 7/1974 | Butler, Jr. et al. | 242/75.44 |
| 3,936,008 | 2/1976 | Crum | 242/75.51 X |
| 4,000,865 | 1/1977 | Gaskins | 242/75.53 X |
| 4,159,808 | 7/1979 | Meihofer | 242/75.5 |

*Primary Examiner*—Stuart S. Levy
*Assistant Examiner*—Steven M. duBois

[57] ABSTRACT

A printing press web tensioning system comprising a motion driven belt drive for the paper reel, dancer roll means, pneumatic means for changing the tension required for deflection of the dancer roll and control means for automatically varying operating values of subcomponents of the tensioning system to carry out webbing, slack removal, start up and normal running operation.

5 Claims, 1 Drawing Sheet

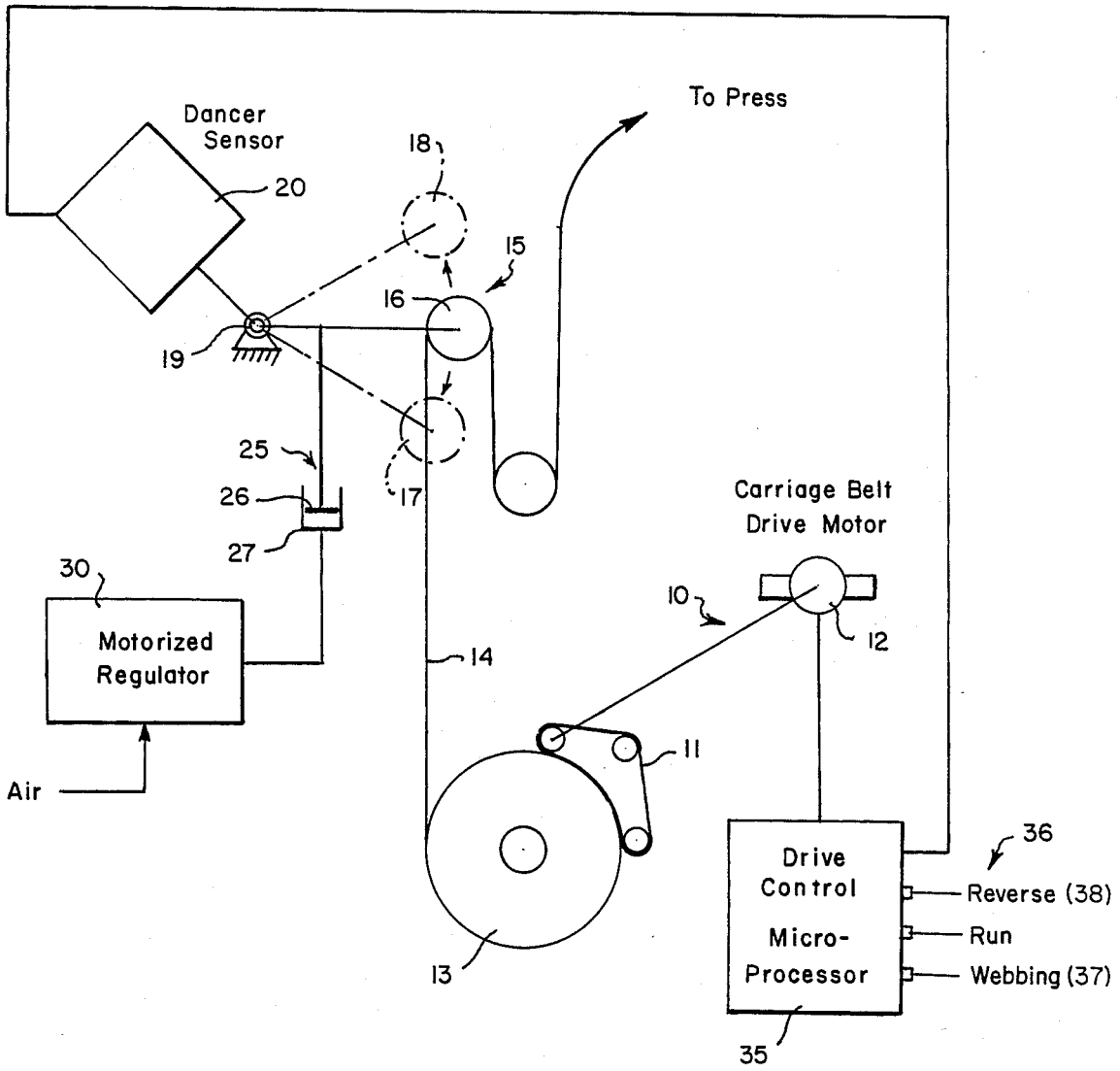
To Press
Dancer Sensor
20
18
15
16
19
25
26
27
17
30
Motorized Regulator
Air
Carriage Belt Drive Motor
10
12
14
11
13
Drive Control
Micro-Processor
35
36
Reverse (38)
Run
Webbing (37)

WEB TENSIONING SYSTEM

This invention relates to web fed rotary printing presses and more particularly to a system for controlling the feeding of web from a supply reel into a web fed printing press.

BACKGROUND OF THE INVENTION

Systems for controlling web tension in printing presses have traditionally been designed only to regulate or control web tension during normal running conditions. Generally, web is removed from a large, heavy reel of newsprint by means of belt-like friction means that are in contact with the surface of the reel and are frequently referred to as surface-driven. After leaving the reel, the web is usually, at some point prior tp printing, entrained about a biasing roller, such as a dancer roll, the purpose of the dancer roll being to permit regulation of the tension in the web by means of appropriate switching and fluid pressure regulators. Controlling tension is necessary, since it varies greatly during printing operations due to change in the weight, speed and diameter of the reel as web is being payed out. Web tension controls utilized heretofore have frequently included not only means to vary the fluid pressure (usually pneumatic) utilized at the dancer roll but to also control braking means to retard rotation of the paper reel.

Typical of prior art devices used for web tension control is that shown in U.S. Pat. No. 3,913,900 where a pendulum or dancer roll 4 is utilized. In this device, change in tension in web 1 causes roll 4 to pivot, and thereby change the setting of potentiometer 15. The potentiometer controls the speed of drive motor 5 to vary the speed of the web and thereby control web tension.

Another example of web tension control is shown in U.S. Pat. No. 3,202,376. Here a sensing roller 37 pivots in response to the tension in loop 38 to effect change in the adjustment means 45, thereby altering the friction between roll 10 and belts 21–23. Increase or decrease in the frictional engagement between roll 10 and belts 21–23 either increases or decreases the rotative speed of the rolls to vary the tension in the web in direct proportion thereto.

Additional examples of mechanisms or systems to control web tension in strands being payed from a supply roll may be found by referring to U.S. Pat. Nos. 3,813,052; 3,811,637; 4,147,516; 1,978,073 and 2,222,462.

A review of all the patents noted above will show that, as already stated, the prior art displays a variety of mechanisms for controlling the tension of webs during the usual printing operation. What the existing art does not indicate is the importance of being able to effectively control web tension when the web is being threaded around the various rolls prior to press start up. During this threading operation, one man is typically required to control the large, high inertia paper roll, in order to keep the web slack and avoid breakage until the web is fully in the press and ready for tension. In addition, once the web is installed, the tension set on the web is usually decreased until the press and web are running well, then readjusted, back up to the original value. All of these operations require a great deal of manual intervention during the busy start up period.

SUMMARY OF THE INVENTION

It is a principal object of this invention to provide a system for controlling the feeding of web from a supply reel through simultaneous monitoring and control of a plurality of feeding conditons.

Another object of this invention is to provide a system for removing slack from the web during the process of preparing for printing operations.

An additional object of this invention is to provide improved control means for simultaneous control of web speed, direction and tension.

These and other objects and advantages of this invention will be in part obvious and in part explained by reference to the accompanying specification and drawing, in which:

The FIGURE is a schematic illustrating the main components in the web feeding control system of this invention.

DESCRIPTION OF THE INVENTION

As mentioned above, the present invention relates to a system for controlling the feeding of web from a supply reel into a web fed printing press. Particularly concerned here is the type of web fed press that is commonly used in the production of daily newspapers in which reels of newsprint of large weight and large diameter are used to supply newsprint for the press. Prior to start-up of the press, it is necessary for the web to be fed from the reel on which it is stored, around one or more guide rolls and ultimately into the press itself where printing is to be carried out. This operation is normally a manual one in which the reel drive and web feeding mechanism are disconnected and the web is threaded manually through the necessary rolls into printing position within the press. In order to understand the present invention more clearly, reference is made to the FIGURE of the drawings in which the numeral 10 identifies carriage belt drive means comprised of reel surface drive belts 11 and a drive motor 12. Operation of motor 12 with the belts 11 in contact with the paper stored on storage reel 13 will either pay-out or take-up web 14, depending upon the direction of rotation of motor 12.

After being payed off from reel 13, the web 14 moves upwardly toward the dancer roll means 15. Dancer roll means 15 includes a dancer roll 16 which is movable between a lowermost position 17 and an uppermost position 18 in response to forces created against it by the tension contained in the traveling web 14. While this dancer roll may be mounted in any manner appropriate to its being movable through a range of positions, it is here shown as being pivotally mounted about a pivot axis 19. On the pivot end 19, there is located sensor means 20 which is operatively connected to said dancer roll means 15 to generate signals that are reflective of the position of the dancer roll means within the path of its vertical travel.

To provide for adjustment of the forces which the web must overcome to effect movement of the dancer roll 16 from the uppermost toward the lowermost position, there is provided pneumatic means 25 which is here shown as being comprised of a piston 26 that is positioned for vertical movement within the cylinder 27. Thus, depending upon the amount of pressure that is contained within the cylinder 27 and against which the piston 26 therefore must act, it will take more or less tension within the web 14 to draw the dancer roll 16 from a position located at or near its uppermost position 18 to its lowermost position 17.

Differential pressure means 30 is provided in the present invention which is connected to the pneumatic means 25 and to a source of air. In the present illustration, differential pressure means 30 is shown as being a motorized regulator which can draw air from a source and supply it under pressure to the cylinder side 27 of the pneumatic means 25.

One of the most important features of the present control system is the means by which the various subcomponents of the overall system are coordinated. In this invention, drive control means 35 is provided which is effective in coordinating the signals received from dancer sensor means 20, providing instructions to the differential pressure means 30 and providing driving instructions to the belt drive motor 12. In the present case, the drive control means is a microprocessor which permits operator selection of predetermined interrelated values of the speed of drive belt motor 12, selection of the pneumatic pressure which should be provided by the motorized regulator 30 to pneumatic means 25 and the selection of the different values of speed for the carriage belt drive motor 12 when undertaking the various steps that go into the preparation of a press for printing. Specifically, presses must normally be webbed up, any slack that may be present in the system removed, started up at a first speed and then subsequently run at a speed and tension which are greater than those used in all of the preceding operations.

In order to select the desired operation of the drive control means 35, there are provided operator means 36 which are associated with the drive control means 35 that permit such operator selection. Specifically, manual devices such as push buttons or levers can be provided which permit an operator to select either a predetermined speed and pressure for the web-up operation, a second and different pressure tension and speed for slack removal operations, yet another combination of speeds and tension for the start up operations and finally, different running conditions for the normal operating situation.

Utilizing the control system of this invention to web-up, the web 14 is pulled over the dancer roll 16 and into the unit (press not shown) utilizing the usual lead in means. The drive belts 11 are then lowered into contact with the paper reel 13 and the webbing switch 37 is activated. When this switch is activated, the pneumatic means 25 produces a pneumatic pressure which is just sufficient to support the dancer roll 16 at its uppermost position 18. Simultaneously, drive belt means 10 will cause forward rotation of the reel 13 at a slow rate, for example, on the order of one to two feet per second. In this mode, any web pressure will pull the dancer roll 16 downwardly since the pressure supporting the roll is only sufficient to support the roll itself without the additional force which is provided by the web. When this occurs, the drive control means 35 will activate the drive motor 12 and cause a slow forward pay out of web 14 from reel 13. This then causes the dancer to again move to the full up position, causing the drive motor 12 to stop. Thus, as the pressman pulls paper from the roll and causes the dancer roll 16 to move from its uppermost position, motor 12 is activated to provide additional paper. This feeding of paper results in the dancer roll against moving to its uppermost position where further pay out of web 14 is stopped. Only after the pressman stops pulling paper does the dancer then stay at the top position and the drive remain off.

After the web 14 has been threaded around the dancer roll 16 and into the press, the operator can activate the reverse switch 38 in the operator means 36, which will cause the carriage drive belt motor 12 to rotate the reel 13 in the reverse or web take-up direction. At the same time, the drive control means 35 causes the motorized regulator 30 to provide a greater pressure to the pneumatic means 25 so that a tension greater than that used for web-up will be required before any vertical movement of the dancer roll 16 can occur. In this reverse running position, this being done at a rate of 25 feet per minute, under a pressure in the pneumatic means of about 15 to 20 psi, web is drawn back onto the reel 13 until the dancer is pulled down to a position located intermediate the uppermost position 18 and the lowermost position 17. The pressure that is being supplied by motorized regulator means 30 is that which corresponds to the tension that is desired in the web. When the dancer roll 16 arrives at a preselected intermediate position, the drive stops. Upon this stopping, the selector switch automatically moves the operation to the slow forward start-up position, this being a mechanical function of the switching means.

At this time, the switching means automatically initiates normal running condition which provides for a start-up tension approximating that of the reverse tension and starting at a slower speed while the press builds up and full running conditions are finally effected.

This invention is not limited to the embodiments shown in the FIGURE and set forth in the description, which are given only by way of example, but is intended to cover modifications and equivalent all within the spirit and scope of the appended claims.

I claim:

1. A system for controlling the feeding of web from a supply reel into a web fed printing unit comprising:

(a) drive means operably connected to the web supply reel to effect rotation thereof;

(b) web guide means mounted to receive the web and to guide it between the supply reel and the printing units, said guide means being movable by the web between first and second limit positions;

(c) sensor and signal generating means operatively connected to said web guide means to identify the positioning of said guide means when at said first and second limit positions and at a position intermediate therebetween;

(d) variable biasing means operatively connected to said web guide means;

(e) differential pressure means connected to said variable biasing means to selectively control the resistance to change in position of said web guide means; and (f) drive control means interconnecting said sensor and signal generating means, said drive means and said differential pressure means, said drive control means including signal processing means to receive the output from said sensor and signal generating means and produce a processed output simultaneously controlling the pressure delivered by said differential pressure means and the speed of said drive means.

2. The system as defined in claim 1 wherein said drive control means includes means for operator selection of separate and different operating parameters for effecting the press web-up, web slack removal and press run operations.

3. The system as defined in claim 2 wherein said web guide means comprises a pivotable mounted dancer roll.

4. The system as defined in clalm 2 wherein said drive means includes carriage belt drive means having reel surface drive belts and a drive motor.

5. The system as defined in claim 2 wherein said drive control means includes operator control means providing (a) slow forward operation of said drive means combined with a pressure in said differential pressure means that just supports said guide means; (b) reverse operation of said drive means at a speed and at a pressure faster and greater, respectively than those used in selection and; (c) forward running operation selection at higher speeds and greater pressures than those used in selections (a) or (b).

* * * * *